US005975884A

United States Patent [19]

Dugger

[11] Patent Number: 5,975,884

[45] Date of Patent: Nov. 2, 1999

[54] STAND-ALONE DEVICE FOR IGNITING, REGULATING AND OPERATING GAS APPLIANCES

[75] Inventor: Arthur Ralph Dugger, Atlanta, Ga.

[73] Assignee: H. Barry Bone, Atlanta, Ga.

[21] Appl. No.: 08/957,538

[22] Filed: Oct. 24, 1997

[51] Int. Cl.[6] ..... F23Q 9/08

[52] U.S. Cl. ..... 431/42; 431/52; 431/60; 431/80; 126/39 BA; 126/39 G

[58] Field of Search ..... 431/42, 80, 51, 431/60, 69, 52; 126/39 R, 38, 41 R, 39 BA, 39 G

[56] References Cited

U.S. PATENT DOCUMENTS

| | | | |
|---|---|---|---|
| 2,181,843 | 11/1939 | Wantz | 431/80 |
| 2,375,569 | 5/1945 | McCarty | 431/52 |
| 2,513,705 | 7/1950 | Arden | 431/52 |
| 2,872,972 | 2/1959 | Matthews | 431/52 |
| 2,920,693 | 1/1960 | Thornbery | 431/52 |
| 3,521,982 | 7/1970 | Dunn | 431/80 |
| 3,620,658 | 11/1971 | Tappin | 431/80 |
| 3,877,458 | 4/1975 | Allander | 126/38 |

*Primary Examiner*—James C. Yeung
*Attorney, Agent, or Firm*—Bernstein & Associates, P.C.

[57] ABSTRACT

A temperature control system for gas operated devices. The system includes a burner (23) that is connected to a gas supply through a regulator (41). A pilot light assembly (26) has a first vane (29) and a second vane (32) which provide a flame for igniting the gas from the burner (23) and for heating a thermocouple (38) to produce a control voltage for operating the regulator (41) and a temperature control (44).

26 Claims, 3 Drawing Sheets

STAND-ALONE DEVICE FOR IGNITING, REGULATING AND OPERATING GAS APPLIANCES

FIELD OF THE INVENTION

The present invention relates to temperature control systems, and more particularly to a temperature control system for controlling the output of gas operated burners.

BACKGROUND OF THE INVENTION

Gases for cooking and heating are often stored in portable tanks which can be transported and refilled. The tanks provide an excellent fuel source for cooking or heating in remote locations. A simple gas burning device is formed by combining a gas tank, a pressure regulator, and a burner. The burner can be mounted below a grate which can be used to support pots or pans for cooking. The gas tank normally has a manual valve for opening and closing the inlet to the tank and a pressure regulator mounted in the gas line between the tank and the burner. The pressure regulator reduces the pressure of the gas down to approximately five to seven and a half inches water column. The gas at this pressure is fed through the burner, and there is a certain amount of temperature control possible by adjusting the pressure regulator to adjust the flame height. For many gas burning applications, however, this type of control is inadequate.

What is needed is a more precise temperature control device which is completely self contained and can be operated without any additional power source other than the tank of gas.

SUMMARY OF THE INVENTION

The present invention provides a temperature control system for gas operated devices.

In a preferred embodiment, the present invention provides a temperature control system for a gas operated device having a pilot light assembly positioned adjacent to a thermocouple. The thermocouple is positioned close enough to the pilot light assembly so that the flame from the pilot light assembly generates a voltage that produces a flow of current. The voltage produced is used as a control voltage to control a pilot operated gas valve and a temperature control. The gas valve is capable of opening in response to the current generated by the thermocouple. The temperature control is electrically wired to the gas valve so that the valve closes when a preset temperature is detected by a temperature sensor.

In the preferred embodiment the output of the gas valve is connected to a burner which is supported adjacent to the pilot light assembly in a cooking apparatus. The cooking apparatus has a set of legs and a cooking surface integrally formed therein. The burner is supported by the apparatus below the cooking surface to provide heat to the cooking surface to heat up pots and pans placed thereon.

Other objects, features, and advantages of the present invention will become apparent upon reading the following detailed description of embodiments of the invention, when taken in conjunction with the accompanying drawings and the appended claims.

BRIEF DESCRIPTION OF THE DRAWINGS

The invention is illustrated in the drawings in which like reference characters designate the same or similar parts throughout the figures of which.

DESCRIPTION OF THE PREFERRED EMBODIMENTS

The temperature control device of the present invention is applicable to the control of any gas burning device and its application to a cooking device is for illustration only.

Figure 1:
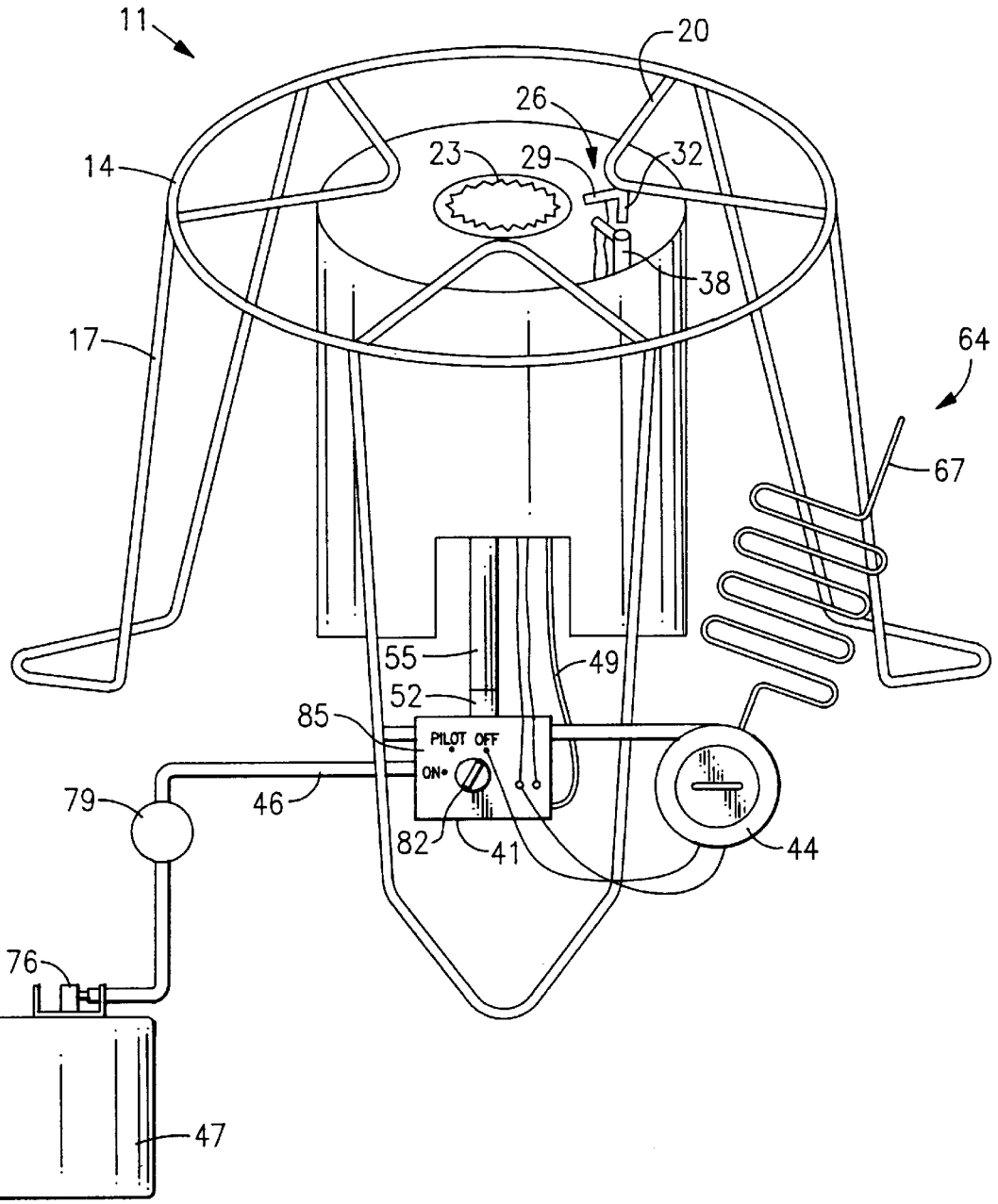
FIG. 1 is a perspective view of the present invention.

In FIG. 1 a cooking apparatus 11 has a frame 14 which has legs 17 and a cooking surface 20 that are formed integrally into the frame 14. The frame 14 is preferably constructed of a rigid, heat resistant, non-corrosive material such as, but not limited to, metal, ceramic, alloy, composite, and the like. The frame can be fixed or collapsible.

The frame 14 supports a burner 23 that is located beneath the cooking surface 20. The burner 23 is preferably sized for approximately forty-thousand BTU'S but the size and output of the burner is not critical. Other sizes and styles of gas burners can be easily adapted to the system depending on the heating requirements of the particular application.

Figure 2:
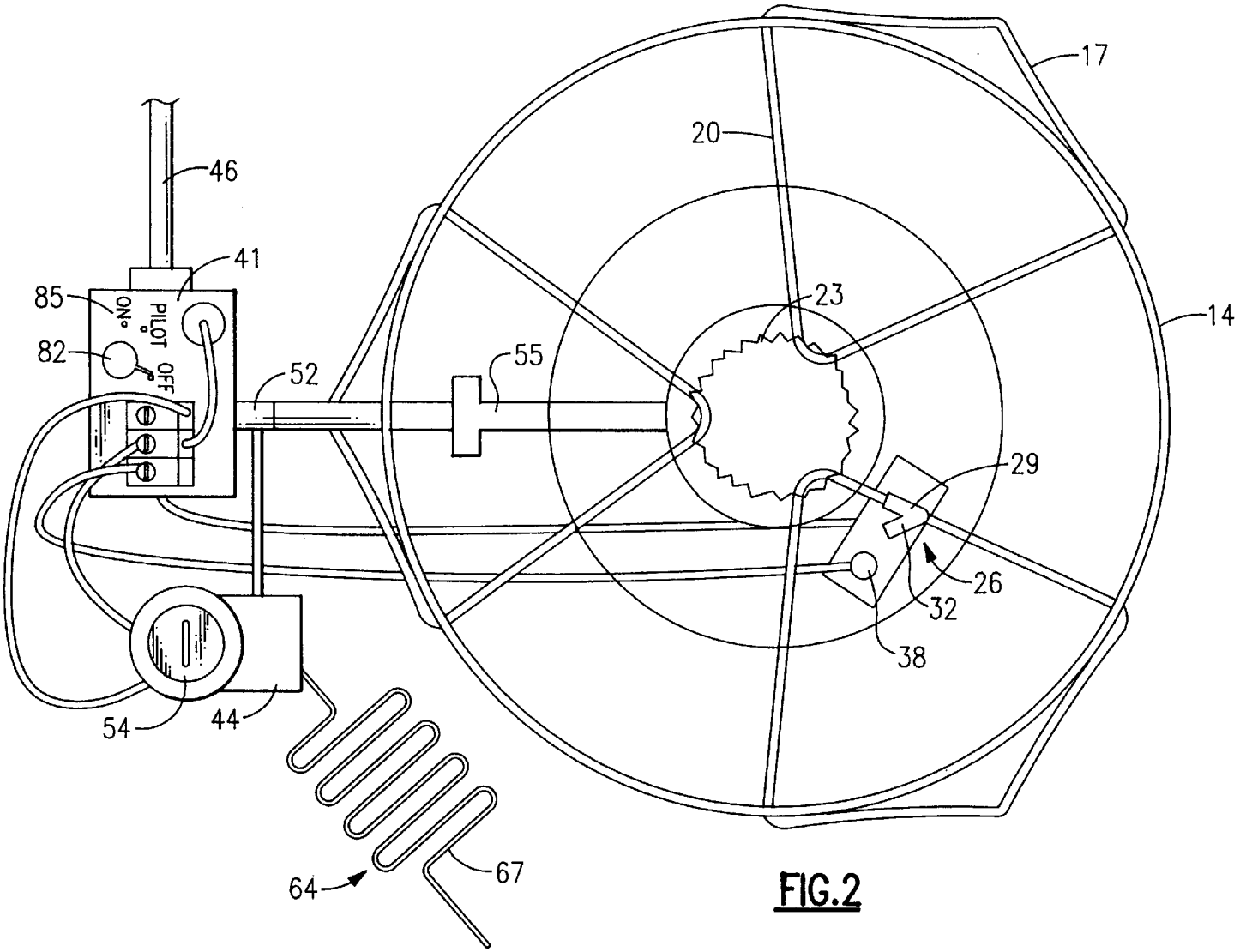
FIG. 2 is a plan view of the present invention.

Referring to FIGS. 1 and 2, the frame also supports a pilot light assembly 26 that is positioned near the burner 23. The pilot light assembly 26 has a first vane 29 and a second vane 32. The first vane 29 is used to provide ignition for the gas entering through the burner 23. The second vane 32 is directed toward a thermocouple 38.

The thermocouple 38 preferably has a number of junctions connected in series, although the number of junctions is not critical. The thermocouple 38 converts the heat of the flame from the pilot light assembly 26 into a DC voltage of approximately 750 millivolts. The voltage produced by the thermocouple 38 is used as a control voltage for a DC circuit that controls the flow of gas to the burner 23 by means of a regulator 41.

The regulator 41 regulates the flow of the gas from the storage tank through an input line 46 and delivers gas to the pilot light assembly 26 through an output line 49 and delivers gas to the burner 23 through an output 52 for the main gas line 55.

Figure 4:
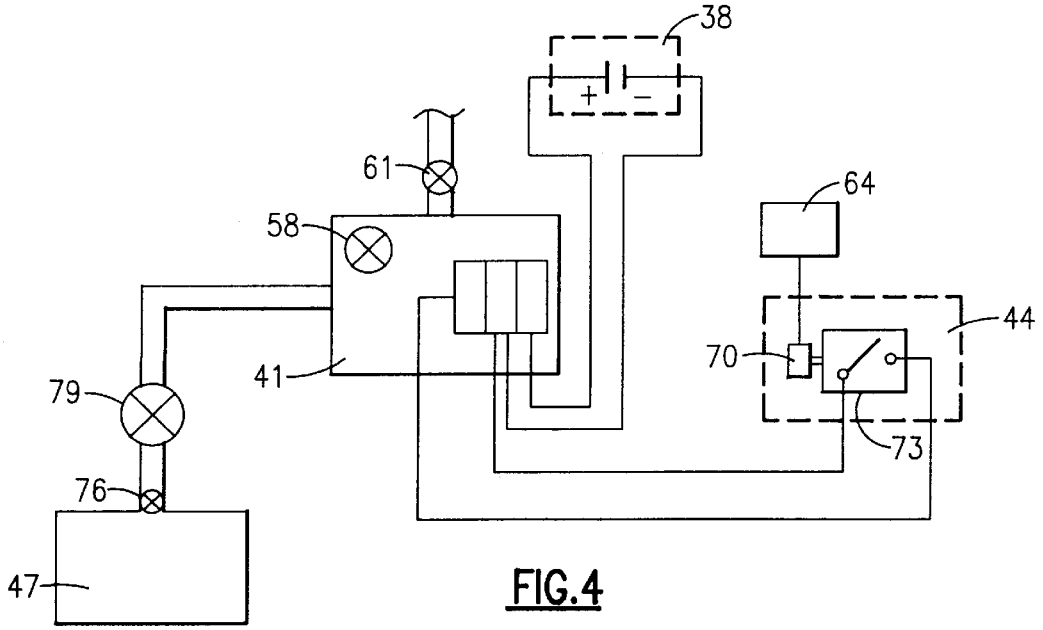
FIG. 4 is an electrical schematic diagram of the present invention.

Referring to FIG. 4, the regulator 41 has an electromagnet-actuated pilot valve 58 that opens a passage way (not shown) inside the regulator 41 which enables the gas from the tank 47 to flow through a main valve 61 to the burner 23. The pressure of the gas from the tank 47, which is in the range of five to seven and one half inches water column, is insufficient to open the main valve 61 unless the pilot valve 58 is opened at the same time. The pilot valve 58 is actuated by the flow of current resulting from the voltage generated by the thermocouple 38. Accordingly, the pilot light assembly 26 must be lit and the thermocouple 38 must be causing current to reach the pilot valve 58 in order for the gas from the main valve 61 to reach the burner 23. Once the gas from the main line 55 passes through the burner 23 it is ignited by the flame from the first vane 29 of the pilot light assembly 26.

The thermocouple 38 generates current which passes through the temperature control 44 which is part of the DC circuit.

The temperature control 44 provides a feedback control loop which can open or close the circuit depending on whether a desired temperature has been reached. The desired temperature is set on a dial 54 that has a graduated scale, preferably in degrees Fahrenheit. A temperature sensor 64 is connected to the temperature control 44. The temperature sensor 64 is preferably a metal capillary tube 67 containing a gas that expands when it is heated. Copper, stainless steel, and chrome plated copper may be used for the tube 67 depending on the temperature range and other commonly known means can be used for sensing. The expansion and contraction of the gas inside the capillary tube 67 activates a bellows chamber 70 which operates a switch 73 inside the temperature control 44. If the temperature detected by the sensor 64 is greater than or equal to the set temperature, the pressure inside the capillary tube 67 will actuate the bellows to open the circuit. When the circuit is opened, the flow of gas to the burner 23 is shut off because the current does not flow to the pilot valve 58. If the temperature detected by the sensor 64 is less than the set temperature, the circuit stays in the normally closed position and the current flows from the thermocouple 38 through the temperature control 44 to the pilot valve 58. The temperature control 44 of the present invention is preferably accurate to within a few degrees.

It is to be understood by those skilled in the art that the temperature feedback control which is controlled by electromechanical switches could be altered to incorporate microprocessor based feedback controls. Also, the regulator 41 could be designed to provide for adjustment of the flame height rather than turning the burner 23 on and off to control the temperature.

Figure 3:
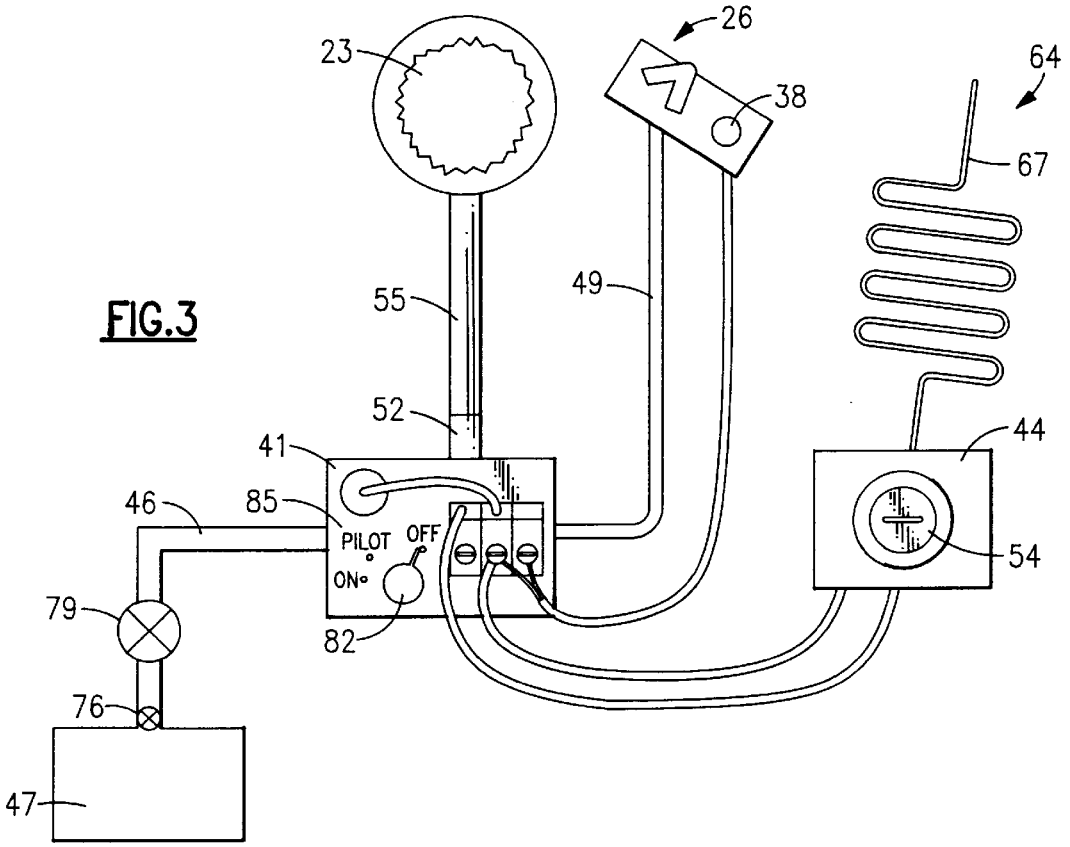
FIG. 3 is a schematic diagram of the present invention.

Referring to FIG. 3, in operation the main valve 76 for the tank 47 is opened and the pressure regulator 79 is opened to allow gas at five to seven and a half inches water column to pass to the input of the regulator 41. It is to be understood that this pressure may be different for different systems. The knob 82 on the regulator 41 is pushed down and over to the indicator 85 marked "pilot." With the knob 82 in the pilot position, a match is held near the pilot light assembly 26. Once the pilot light assembly is ignited the thermocouple 38 will begin to heat up and generate voltage. After approximately thirty seconds to a minute, the knob 82 can be released and then turned to the "on" position. At this time if the thermocouple 38 has generated enough current to actuate the pilot valve 58, the burner 23 will be ignited from the pilot light assembly 26. With the regulator 41 in the "on" position, the temperature dial 54 on the temperature control 44 can be set to the desired temperature. Until the temperature reading from the sensor 64 reaches the set temperature, the burner 23 will continue to receive gas from the main line 55 as long as the thermocouple 38 is producing current. Once the desired temperature is reached, the bellows member 70 will throw open a switch and the current will not pass to the pilot valve 58 which will stop the flow of gas to the burner 23.

Accordingly, the present invention offers many advantages including the ability to precisely control the temperature output of a gas operated device without the need for any external source of electricity.

Another advantage is that the device will not allow gas to enter the burner 23 through the main line 55 if the pilot light assembly 26 is not lit. It will not allow gas to enter the burner 23 because if the pilot light assembly 26 is not lit then the thermocouple 38 is not producing the voltage necessary to activate the regulator 41.

Yet another advantage to the present invention is that the control system can be used in several different cooking applications including deep frying, grilling, or smoking meats and fish. The other cooking applications would work under the same principles except the burners and the temperature sensors may be modified. The present invention can also be used to control the temperature for certain heating devices for use in remote areas where the only supply of gas is from tanks and there is no electricity.

While the invention has been described in connection with certain preferred embodiments, it is not intended to limit the scope of the invention to the particular forms set forth, but, on the contrary, it is intended to cover such alternatives, modifications, and equivalents as may be included within the spirit and scope of the invention as defined by the appended claims.

I claim:

1. An apparatus for controlling the temperature output of a gas operated device, comprising:

a) a pilot light assembly having at least one vane and a pilot gas valve;

b) a thermocouple positioned in proximity to the vane so that heat from the pilot light assembly is capable of generating voltage that causes an electrical current to flow;

c) a main gas valve connected to a supply of gas and electrically wired to the thermocouple so that the main valve is capable of opening in response to the electric current from the thermocouple and the main valve is capable of closing in response to the lack of the electric current from the thermocouple, the main valve associated with the pilot valve such that the main valve opens when the pilot valve opens; and d) a temperature control comprising a temperature sensor, the temperature control electrically wired to the main valve and the thermocouple so that the main valve closes when a preset temperature is detected by the temperature sensor, the temperature control electrically operated by the electric current from the thermocouple independently of an external power supply, wherein the pilot valve and main valve are manually opened for igniting the gas operated device and thereafter the control voltage to the temperature control for operating the main valve is provided by the electric current generated by the thermocouple independently of an external electric power supply.

2. The apparatus of claim 1, wherein the pilot light assembly has a first vane and a second vane, both connected to the pilot light assembly, the second vane being directed toward the thermocouple.

3. The apparatus of claim 2, wherein the temperature sensor is connected to an electrical switch.

4. The apparatus of claim 3, wherein the temperature sensor causes the electrical switch to open when a preset temperature is reached.

5. The apparatus of claim 1, wherein the temperature sensor is connected to an electrical switch.

6. The apparatus of claim 5, wherein the temperature sensor causes the electrical switch to open when a preset temperature is reached.

7. An apparatus for controlling the temperature output of a gas operated device, comprising:

a) a pilot light assembly having at least one vane and a pilot gas valve;

b) a thermocouple positioned in proximity to the vane so that heat from the pilot light assembly is capable of generating voltage that causes an electrical current to flow;

c) a main gas valve connected to a supply of gas and electrically wired to the thermocouple so that the main valve is capable of opening in response to the electric current from the thermocouple and the main valve is capable of closing in response to the lack of the electric current from the thermocouple, the main valve associated with the pilot valve such that the main valve opens when the pilot valve opens;

d) a temperature control comprising a temperature sensor, the temperature control electrically wired to the main valve and the thermocouple so that the main valve closes when a preset temperature is detected by the temperature sensor, the temperature control electrically operated by the electric current from the thermocouple independently of an external power supply; and, e) a gas burner connected to the main valve and positioned near the vane such that gas from the main valve is capable of passing through the burner and being caused to ignite by the pilot light assembly, wherein the pilot valve and main valve are manually opened for igniting the gas operated device and thereafter the control voltage to the temperature control for operating the main valve is provided by the electric current generated by the thermocouple independently of an external electric power supply.

8. The apparatus of claim 7, wherein the pilot light assembly has a first vane and a second vane, both connected to the pilot light assembly, the second vane being directed toward the thermocouple.

9. The apparatus of claim 8, wherein the temperature sensor is connected to an electrical switch.

10. The apparatus of claim 9, wherein the temperature sensor causes the electrical switch to open when a preset temperature is reached.

11. The apparatus of claim 7, wherein the temperature sensor is connected to an electrical switch.

12. The apparatus of claim 11, wherein the temperature sensor causes the electrical switch to open when a preset temperature is reached.

13. An apparatus for controlling the temperature output of a gas operated device, comprising:

a) a pilot light assembly having at least one vane and a pilot gas valve;

b) a thermocouple positioned in proximity to the vane so that heat from the pilot light assembly is capable of generating voltage that causes an electrical current to flow;

c) a main gas valve connected to a supply of gas and electrically wired to the thermocouple so that the main valve is capable of opening in response to the electric current from the thermocouple and the main valve is capable of closing in response to the lack of the electric current from the thermocouple, the main valve associated with the pilot valve such that the main valve opens when the pilot valve opens;

d) a temperature control comprising a temperature sensor, the temperature control electrically wired to the main valve and the thermocouple so that the main valve closes when a preset temperature is detected by the temperature sensor, the temperature control electrically operated by the electric current from the thermocouple independently of an external power supply; and, e) a gas burner connected to the main valve and positioned near the vane such that gas from the main valve is capable of passing through the burner and being caused to ignite by the pilot light assembly; and, f) a frame supporting the pilot light assembly, the gas burner, the thermocouple, the temperature control and the main valve, wherein the pilot valve and main valve are manually opened for igniting the gas operated device and thereafter the control voltage to the temperature control for operating the main valve is provided by the electric current generated by the thermocouple independently of an external electric power supply.

14. The apparatus of claim 13, further comprising:

a) a set of legs connected to the frame; and, b) a support surface attached to the set of legs.

15. The apparatus of claim 13, wherein the pilot light assembly has a first vane and a second vane, both connected to the pilot light assembly, the second vane being directed toward the thermocouple.

16. The apparatus of claim 15, wherein the temperature sensor is connected to an electrical switch.

17. The apparatus of claim 16, wherein the temperature sensor causes the electrical switch to open when a preset temperature is reached.

18. The apparatus of claim 13, wherein the temperature sensor is connected to an electrical switch.

19. The apparatus of claim 18, wherein the temperature sensor causes the electrical switch to open when a preset temperature is reached.

20. An apparatus for controlling the temperature output of a gas operated device, comprising:

a) a pilot light assembly having at least one vane and a pilot means for controlling the flow of a supply of gas;

b) means for generating DC control voltage from a heat source and positioned in proximity to the heat source so that the heat therefrom is capable of generating voltage that causes an electrical current to flow;

c) main means for controlling the flow of a supply of gas, the main control means electrically wired to the generating means so that the main control means is capable of operating in response to the control voltage from the generating means, the main control means associated with the pilot valve such that the main control means opens to allow a flow of gas therethrough when the pilot control means opens to allow a flow of gas therethrough; and, d) a temperature control comprising a temperature sensor, the temperature control electrically wired to the main control means and the generating means so that the main control means closes when a preset temperature is detected by the temperature sensor, the temperature control electrically operated by the electric current from the generating means independently of an external power supply, wherein the pilot control means and main control means are manually opened for igniting the gas operated device and thereafter the control voltage to the temperature control for operating the main control means is provided by the electric current from the generating means independently of an external electric power supply.

21. The apparatus of claim 20, wherein the generating means comprises a thermocouple.

22. The apparatus of claim 20, wherein the pilot light assembly has a first vane and a second vane, both connected to the pilot light assembly, the second vane being directed toward the thermocouple.

23. The apparatus of claim 22, wherein the temperature sensor is connected to an electrical switch.

24. The apparatus of claim 23, wherein the temperature sensor causes the electrical switch to open when a preset temperature is reached.

25. The apparatus of claim 20, wherein the temperature sensor is connected to an electrical switch.

26. The apparatus of claim 25, wherein the temperature sensor causes the electrical switch to open when a preset temperature is reached.

* * * * *